United States Patent [19]

Jan

[11] Patent Number: 4,894,756

[45] Date of Patent: Jan. 16, 1990

[54] DIVERSIFIED BOOKREST

[76] Inventor: Boo Lin Jan, No. 78, BO I Street, Shinchu City, Taiwan

[21] Appl. No.: 248,100

[22] Filed: Sep. 23, 1988

[51] Int. Cl.[4] ..... A47B 23/06

[52] U.S. Cl. ..... 362/97; 248/441.1

[58] Field of Search ..... 362/98, 97, 418; 248/441.1, 455, 457; 33/1 K, 438, 430, 448

[56] References Cited

U.S. PATENT DOCUMENTS

| | | | |
|---|---|---|---|
| 1,279,828 | 9/1918 | Brassard | 362/97 |
| 1,990,104 | 2/1935 | Van Alstyne | 248/455 |
| 2,328,471 | 8/1943 | Leffel | 362/97 |
| 2,430,862 | 11/1947 | Carscallen et al. | 362/98 |
| 2,579,740 | 12/1951 | Hiemenz | 248/455 |
| 2,642,841 | 6/1953 | Funk | 33/448 |
| 2,643,326 | 6/1953 | Knapp | 362/97 |
| 4,430,797 | 2/1984 | Eder | 33/438 |
| 4,466,593 | 8/1984 | Odenath | 248/455 |

*Primary Examiner*—Ira S. Lazarus
*Assistant Examiner*—Richard R. Cole
*Attorney, Agent, or Firm*—Bacon & Thomas

[57] ABSTRACT

A bookrest includes a transparent board, a mounting frame, a fluorescent lamp assembly held behind the board, a 3-dimensionally adjustable rule fixed to the board and a pen stand placed alongside one side of the board wherein one or more element(s) can be dropped out if it (they) is (are) not required when one uses the bookrest.

1 Claim, 4 Drawing Sheets

DIVERSIFIED BOOKREST

BACKGROUND OF THE INVENTION

The present invention relates to a bookrest, and more particularly to an inclination-adjustable bookrest.

In order to free one from feeling uncomfortable or getting tired easily when he is reading a book or the like, numerous kinds of bookrests have been marketed but only bear a single function so that they are not popular. It is therefore tried by the Applicant to diversify the bookrest.

SUMMARY OF THE INVENTION

It is therefore an object of the present invention to diversify the function of a bookrest. It is further an object of the present invention to provide a bookrest capable of tracing thereon a drawing or showing thereon the content of a film or a lantern slide. It is yet an object of the present invention to provide a bookrest provided with a 3-dimensionally adjustable rule. According to the present invention, a bookrest includes a transparent board, a mounting frame, a fluorescent lamp assembly held behind the board, a 3-dimensionally adjustable rule fixed to the board and a pen stand placed alongside one side of the board. The present invention may best be understood through the following description with reference to the accompanying drawings, in which:

DETAILED DESCRIPTION OF THE PREFERRED EMBODIMENT

Figure 1:
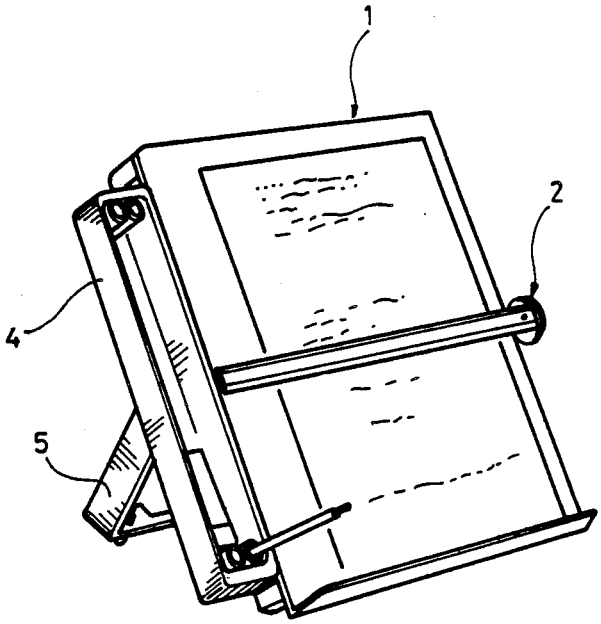
FIG. 1 is a perspective view showing a preferred embodiment of a bookrest of the present invention.
Figure 2:
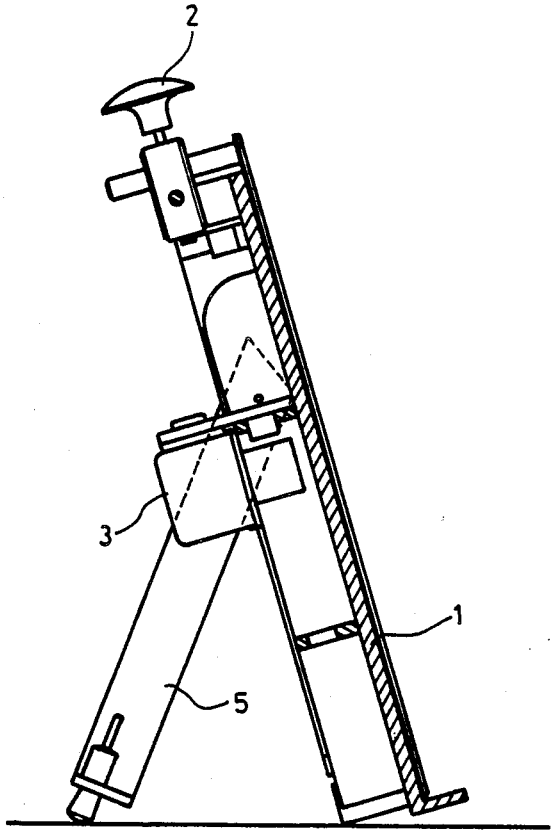
FIG. 2 is a side view of a bookrest in FIG. 1.
Figures 3, 6:
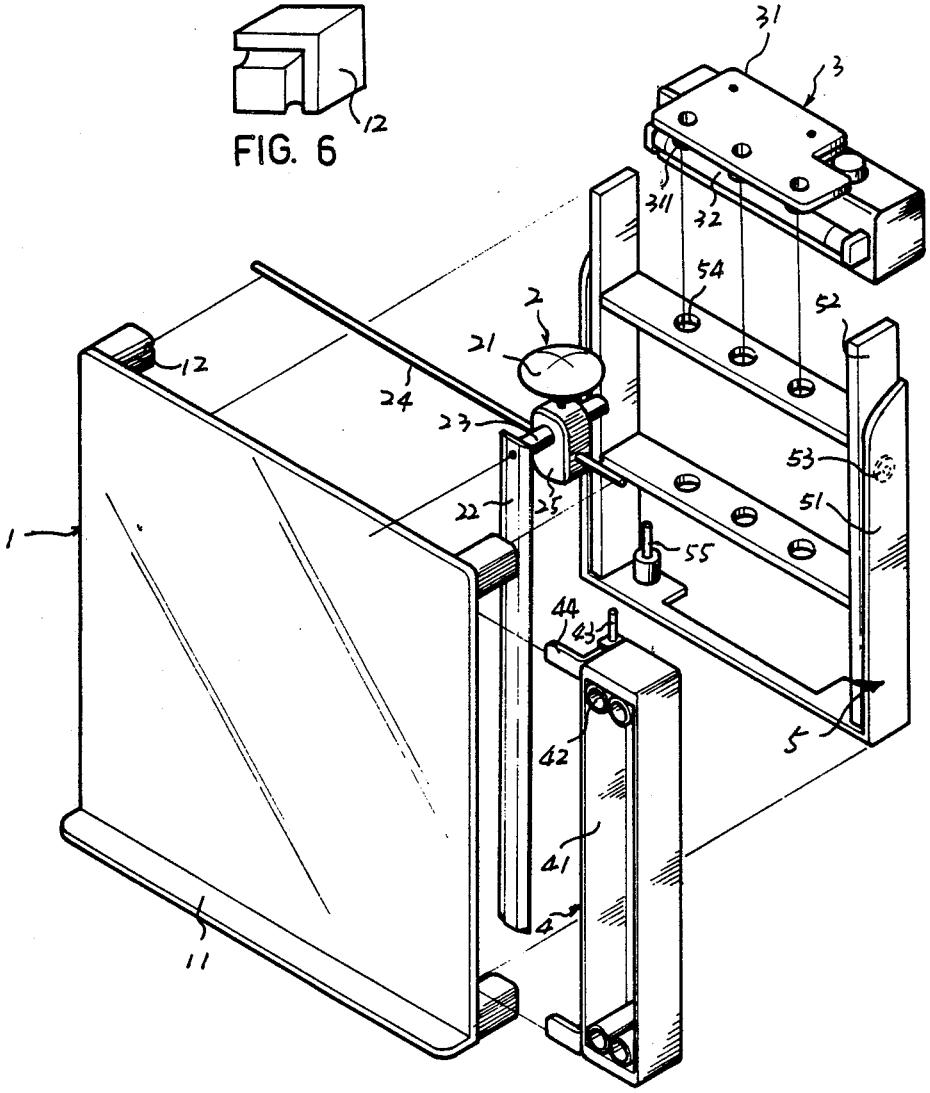
FIG. 3 is an exploded view of a bookrest in FIG. 1.
FIG. 6 is a perspective view showing a corner positioner of a transparent board of a bookrest according to the present invention.
Figure 4:
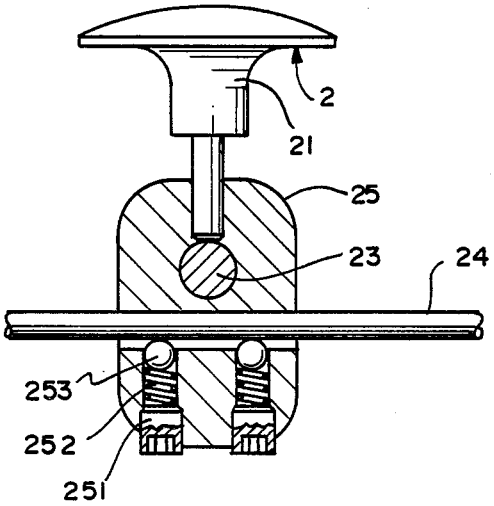
FIG. 4 is a sectional view showing a mounting piece of a bookrest in FIG. 1.

Referring now to FIGS. 1~6, a diversified bookrest according to the present invention includes a transparent rectangular board 1 for placing thereon a book or the like, a rule assembly 2 capable of being 3-dimensionally adjusted, a fluorescent lamp assembly 3 providing a light source for facilitating to trace on board 1 a drawing or to show thereon a film or a lantern slide, a pen stand 4 for standing thereon a pen or placing therein an article for reading or writing, and a mounting frame 5 pivotally connecting thereto board 1 and height-adjustably mounting thereon lamp assembly 3.

Board 1 includes a bottom ledge 11 for stopping thereon a book or the like or temporarily spacing thereon a pen or the like, and four grooved corner positioners 12 for detachably engaging thereto rule assembly 2 and/or pen stand 4. Rule assembly 2 includes an adjusting knob 21, a rule 22, a securing rod 23 screwing thereto the rule 22, a positioning rod 24 secured between grooves of two adjacent positioners 12, and a mounting piece 25 threadedly attaching thereto the knob 21 urging against the securing rod 23 slidably and rotatably mounted on a mounting piece 25 slidably fixed on a positioning rod 24 so that rule 22 is 3-dimensionally adjustable. Mounting piece 25 includes two bottom holes each of which receives therein a ball 253 engaging with positioning rod 24, a spring 252 and a threaded piece 251 capable of being rotated to urge the spring 252 against the ball 253 so that rule assembly 2 can be smoothly slid along the positioning rod 24.

Fluorescent lamp assembly 3 includes a mounting medium 31 having three projections 311, and a fluorescent lamp 32 including a housing, an internal stabilizer and a starter as in the prior art for providing a light source. A pen stand 4 includes a housing 41 having 4 pen sockets 42, connecting rods 43 inserted into respective grooves of two adjacent positioners 12 and securing tabs 44 engaging with the back of the board 1 when connecting rods 43 inserted into respective positioners 12 for auxiliarily positioning and the supporting housing 41. A mounting frame 5 includes a movable sub-frame 51, having two rubber feet 55 and a fixed sub-frame 52 which is pivotally attached to the sub-frame 51 by two opposite pivotable joints 53 and held attached to the back of the board 1 and includes two vertically spaced mounting elements each of which includes three holes 54 capable of receiving therein projections 311 so that the mounting medium 31 is height-adjustably mounted on the fixed sub-frame 52.

Figure 5:
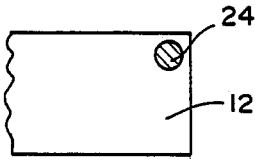
FIG. 5 is a scrematic view showing the engagement between a corner positioner of a transparent board and a positioning rod of a bookrest in FIG. 1.

As schematically shown in FIG. 5, the positioning rod 24 can be mounted between any adjacent two of corner positioners 12 so that the rule assembly 2 can be selectively mounted on the most suitable position. Likewise, the connecting rods 43 can be inserted into respective grooves of any adjacent two of corner positioners 12 also so that the pen stand 4 and be placed alongside any desired side of the board 1.

The advantages achieved by the present bookrest can be summarized as follows:

(1) The inclination of the board 1 can be adjusted as desired by pivoting the board 1 with respect to the movable sub-frame 51.

(2) One can trace a drawing or show a film or a lantern slide on the board 1.

(3) One can selectively attach the rule assembly 2 and/or the pen stand 4 on a most appropriate position with respect to the board 1 he believes.

(4) One can detach one (e.g., the rule assembly 2) or more elements from the board 1 at his wish to simplify the structure of the present bookrest. Through the above description, it should now become readily apparent how and why the present invention can achieve the objects it contemplates.

What I claim is:

1. A diversified bookrest comprising: a transparent rectangular board having corner positioners; a mounting frame having a first sub-frame and a second sub-frame which is pivotally attached to said first sub-frame and held attached behind said rectangular board and includes vertically spaced mounting elements; a fluorescent lamp assembly capable of being selectively mounted on one of said mounting elements; a rule secured to said positioners and capable of being 3-dimensionally adjusted with respect to said board; a pen stand secured to said positioners for being placed alongside one side of said rectangular board; a positioning rod secured to said positioners; a mounting piece slidably fixed on said positioning rod, and having a hole receiving therein a ball engaging with said positioning rod, a spring and a threaded piece capable of being rotated to urge said spring against said ball; and a securing rod slidably and rotatably mounted on said mounting piece and securing thereto said rule.

* * * * *